US011584126B2

(12) United States Patent
Tori et al.

(10) Patent No.: US 11,584,126 B2
(45) Date of Patent: Feb. 21, 2023

(54) MULTI-CHIP MODULE (MCM) ASSEMBLY

(71) Applicant: SICPA HOLDING SA, Prilly (CH)

(72) Inventors: Silvano Tori, Chiaverano (IT); Marco Sarti, Turin (IT); Paolo Cappello, Romano Canavese (IT)

(73) Assignee: SICPA HOLDING SA, Prilly (CH)

( * ) Notice: Subject to any disclaimer, the term of this patent is extended or adjusted under 35 U.S.C. 154(b) by 35 days.

(21) Appl. No.: 17/265,144

(22) PCT Filed: Jul. 15, 2019

(86) PCT No.: PCT/EP2019/068989
§ 371 (c)(1),
(2) Date: Feb. 1, 2021

(87) PCT Pub. No.: WO2020/025302
PCT Pub. Date: Feb. 6, 2020

(65) Prior Publication Data

US 2021/0323305 A1 Oct. 21, 2021

(30) Foreign Application Priority Data

Jul. 30, 2018 (EP) ..... 18186272

(51) Int. Cl.
*B41J 2/14* (2006.01)
*B41J 2/045* (2006.01)

(52) U.S. Cl.
CPC ..... *B41J 2/14* (2013.01); *B41J 2002/14491* (2013.01); *B41J 2202/19* (2013.01); *B41J 2202/20* (2013.01)

(58) Field of Classification Search
CPC ..... B41J 2/14; B41J 2/14024; B41J 2/14129; B41J 2/1433; B41J 2/04501; B41J 2002/14491
See application file for complete search history.

(56) References Cited

U.S. PATENT DOCUMENTS 5,016,023 A 5/1991 Chan et al.
5,939,206 A 8/1999 Kneezel et al.
(Continued)

FOREIGN PATENT DOCUMENTS

CN 1417031 5/2003
CN 1500043 5/2004
(Continued)

OTHER PUBLICATIONS

International Search Report and Written Opinion issued with respect to application No. PCT/EP2019/068989.
(Continued)

*Primary Examiner* — Jason S Uhlenhake
(74) *Attorney, Agent, or Firm* — Muncy, Geissler, Olds & Lowe, P.C.

(57) ABSTRACT

A multi-chip module (MCM) assembly comprising: a graphite substrate having a front surface and a back surface and comprising a plurality of silicon chips mounted on the front surface, a Printed Wiring Board (PWB) attached to the graphite substrate and provided with openings surrounding outer profiles of the silicon chips, the graphite substrate comprises one or more ink channels on the back surface and one or more ink feeding slots passing through the graphite substrate and being in fluidic communication with the respective one or more ink channels, so that each of the silicon chips can be fed with one or more different types of inks, the MCM assembly further comprises a graphite cover plate configured to cover the one or more ink channels of the graphite substrate.

8 Claims, 3 Drawing Sheets

(56) References Cited

U.S. PATENT DOCUMENTS

| | | | |
|---|---|---|---|
| 2002/0140777 | A1 | 10/2002 | Silverbrook et al. |
| 2006/0012638 | A1 | 1/2006 | Lee |
| 2007/0046739 | A1 | 3/2007 | Lee et al. |
| 2007/0076049 | A1 | 4/2007 | Cho et al. |
| 2009/0102899 | A1 | 4/2009 | Rutten et al. |
| 2009/0141063 | A1 | 6/2009 | Takano et al. |
| 2011/0175219 | A1 | 7/2011 | Cellura et al. |
| 2011/0292124 | A1 | 12/2011 | Anderson et al. |
| 2015/0124025 | A1 | 5/2015 | Yamada et al. |
| 2016/0023461 | A1* | 1/2016 | Chen ..... B41J 2/1607 156/60 |
| 2018/0170050 | A1 | 6/2018 | Chen et al. |

FOREIGN PATENT DOCUMENTS

| | | | |
|---|---|---|---|
| CN | 1721194 | | 1/2006 |
| CN | 1923517 | | 3/2007 |
| CN | 1944057 | | 4/2007 |
| CN | 102470671 | | 5/2012 |
| EP | 2839960 | | 2/2015 |
| JP | 2007-301729 | A | 11/2007 |
| JP | 2007301729 | A * | 11/2007 |
| TW | 200918332 | | 5/2009 |
| WO | 2011011807 | | 2/2011 |
| WO | 2017/198819 | A1 | 11/2017 |
| WO | 2017/198820 | A1 | 11/2017 |

OTHER PUBLICATIONS

Taiwan Office Action issued in counterpart Taiwan Patent Application No. 108120467 dated May 5, 2022 (and English language translation of Office Action), 13 pages.

First Office Action and Search Report issued in corresponding Chinese Application No. 201980050361.8 dated Mar. 15, 2022 (and English language translation of the Office Action).

* cited by examiner

MULTI-CHIP MODULE (MCM) ASSEMBLY

TECHNICAL FIELD

The present invention relates to the technical field of a thermal ink printing technology, especially to a wide-page printing technology, and in particular to a multi-chip module assembly.

BACKGROUND ART

The concept of a multi-chip module (MCM) has been well known for a long time. Technological and economical reasons dissuade the manufacturers from increasing the length of a silicon chip. Accordingly, a longer and more effective print swath can be reasonably obtained only through a plurality of silicon chips, properly disposed onto a rigid substrate and thereby forming the MCM. Shaping the outer profile of a single MCM in a suitable way allows building an even longer printing bar, through the simple juxtaposition of several MCMs.

U.S. Pat. No. 5,016,023 discloses a structure comprising printheads, which are offset with respect to adjacent printheads by an amount at least equal to a width dimension of a printhead. The disclosed structure involves a use of a ceramic material as a substrate suitable for withstanding certain elevated temperatures. However, the manufacturing process of the ceramic substrate is rather expensive, because it requires a specific mold to get the desired shape at once or, alternatively, the use of some hard-tooling equipment to machine such a hard material. Moreover, the set of buss lines and IC packages disclosed in U.S. Pat. No. 5,016,023 are also rather complex and therefore not technologically efficient, reliable and cost-effective.

U.S. Pat. No. 5,939,206 describes an apparatus which comprises at least one semiconductor chip mounted on a substrate, said substrate comprising a porous, electrically conductive member having electrophoretically deposited thereon a coating of a polymeric material, wherein said porous, electrically conductive member comprises graphite or a sintered metal. However, the construction and maintenance of an electrophoretic deposition line is rather expensive that makes the apparatus manufacturing process complex and costly.

It is therefore an object of the present invention to overcome the shortcomings of the prior art and to provide a Multi-Chip Module assembly, which is simple, robust, effective, safe, cheap, easy to manufacture due to eliminating of complex operations and the need of using molded parts, and which has an overall improved reliability.

SUMMARY OF THE INVENTION

According to one aspect, the present invention relates to a multi-chip module (MCM) assembly comprising:

a graphite substrate having a front surface and a back surface and comprising a plurality of silicon chips mounted on the front surface, wherein the MCM assembly further comprises a Printed Wiring Board (PWB) attached to the graphite substrate and provided with openings surrounding outer profiles of the silicon chips, the graphite substrate comprises one or more ink channels on the back surface and one or more ink feeding slots passing through the graphite substrate and being in fluidic communication with the respective one or more ink channels, so that each of the silicon chips can be fed with one or more different types of inks, and wherein the MCM assembly further comprises a graphite cover plate configured to cover the one or more ink channels of the graphite substrate.

The use of a simple Printed Wiring Board (PWB) provided with openings surrounding the silicon chips of the MCM assembly, provides a simple way to realize the electrical contacts, even if the bonding pads are distributed along opposite sides of the chip. Due to the integration of the ink port with ink channels directly on the graphite substrate, there is no need for a molded ink port, shaped to house the ink channels, as in the prior art. Graphite cover plate in combination with the graphite substrate provides a compact module, easy to manufacture and to mount/remove from the main equipment.

According to a further aspect of the invention, the MCM assembly further comprises an intermediate adhesive layer of a pre-impregnated composite fiber arranged between the graphite cover plate and the graphite substrate. The intermediate adhesive layer of a pre-impregnated composite fiber comprises apertures conformal to the ink channels of the graphite substrate.

According to a further aspect of the invention, an inner surface of the graphite cover plate is flat. Alternatively, an inner surface of the graphite cover plate can comprise ink channels conformal to the ink channels of the graphite substrate.

According to a further aspect of the invention, the PWB is attached to the graphite substrate by means of an intermediate adhesive layer of a pre-impregnated composite fiber having apertures conformal to the ink channels of the graphite substrate. Alternatively, the PWB can comprise a layer of a pre-impregnated composite fiber having apertures conformal to the ink channels of the graphite substrate.

Preferably, the graphite cover plate comprises the ink inlet and outlet ports having sealing O-rings. This enables to provide the hermetic sealing of the module after insertion in the printing equipment.

According to a further aspect of the invention, the pre-impregnated composite fiber between the graphite cover plate and the graphite substrate is of the same type as the pre-impregnated composite fiber between the PWB and the graphite substrate. Alternatively, the pre-impregnated composite fiber between the graphite cover plate and the graphite substrate is of different type from the pre-impregnated composite fiber between the PWB and the graphite substrate.

The present invention will be described more fully hereinafter with reference to the accompanying drawings in which same numerals represent same elements throughout the different figures, and in which prominent aspects and features of the invention are illustrated.

DETAILED DESCRIPTION

To increase the swath length in a printhead a possible solution is to align a plurality of silicon chips onto a single substrate, forming a Multi-Chip Module (MCM) to obtain an effective larger printing swath.

The substrate material should be stiff, in order to avoid possible dangerous bending which can damage the silicon chips, and its Coefficient of Thermal Expansion (CTE) should be close to the CTE of silicon, in order to prevent a large stress arising after the assembling. It should be machined easily to provide a flat surface for the chip fixture and all the details for the assembling: ink slots for feeding the ink from the backside, bushing housings for the MCM fixture to an external support, trenches to house the hydraulic glue and so on. Sintered graphite is a suitable material for this purpose: it can fulfill all the mentioned requirements and, moreover, it is cheap. Plates of sintered graphite are available, for example, from TOYO TANSO—Osaka (Japan). A possible drawback of sintered graphite is its porosity, which allows the material to soak the ink, particularly when solvent inks are used. However, implementation of a suitable sealing agent and a chemically compatible glue, such as, but not limited to, the ones disclosed in WO 2017198819 A1 or WO 2017198820 A1, enables to attach the silicon chip to the graphite substrate, after treating with the sealing agent.

According to the present invention, a Printed Wiring Board (PWB) is fixed onto the substrate of the MCM, to provide the electrical connection with the plurality of silicon chips. The silicon chips are assembled onto the substrate, which thermomechanical stability allows maintaining the respective position and alignment of the ejecting elements, whilst the PWB provides the electrical connections with the external controller. If the silicon chips were directly assembled onto the PWB, its poor thermomechanical stability would prevent the stable respective positioning of the ejecting elements, with detrimental effects on the printing quality.

Figure 1:
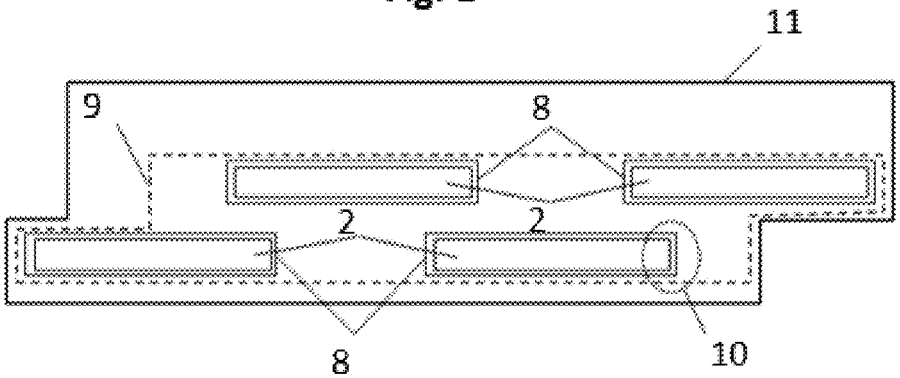
FIG. 1 is a schematic illustration of the MCM assembly according to the invention.

As illustrated in FIG. 1, in order to provide suitable electrical contacts to the silicon chips, the PWB 11 has openings 8 surrounding the outer profile of the silicon chips 2. With reference to the right side of the lower-right silicon chip in the MCM, the region enclosed in the dotted circle 10 includes bonding pads on both the silicon chip and the PWB, facing each other, which are connected with conductive wires through a suitable method, e.g. Wire Bonding. A sealing glue can be applied after the Wire Bonding so as to incorporate the bonding pads of both chip and board, together with the connecting wires, in order to give both electrical and mechanical protection.

The outer profile of the underlying graphite substrate is indicated by the dotted line 9. The structure composed by the MCM and the attached PWB, with the chip pads and the board pads electrically connected, forms the MCM assembly.

In contrast to the prior art, where the PWB is attached to the underlying substrate of the MCM through a double-side adhesive tape, a more efficient method for bonding the PWB to the substrate of the MCM has been developed. It consists in using of an intermediate adhesive layer, which is a sheet of a pre-impregnated composite fiber, including a thermoset material, or the so-called pre-preg. Pre-preg is available, for example, from TUC—Zhubei (Taiwan). The thermoset material is only partially cured, to facilitate handling. By applying high pressure (about 20 bar) and high temperature (about 200° C.) for a long time (about 3 hours) to a "sandwich" composed by PWB+pre-preg+substrate, a very reliable bonding is obtained between the parts. The PWB can comprise the intermediate adhesive layer (or pre-preg layer) preliminary deposed onto the surface and suitably shaped so as to be conformal to the PWB profile.

To bring out the electrical contacts from the PWB to the external controller, different methods can be used. A standard multi-pin socket mounted on the PWB can be adopted, which is able to house a plug connected to a flexible cable, going, in turn, to the controller. This solution, however, shows a poor reliability in the electrical contact between plug and socket with respect to the mechanical stability and it is not infrequent to find a missing contact during the functioning of the MCM.

A more stable contact can be obtained using a series of "pogo pins" as a contacting array on the printing equipment, with a corresponding array of contact pads on the PWB. Pogo pin connectors are available, for example, from INGUN—Fino Mornasco (Italy). Since each pin is spring-loaded, the mechanical strength of the contact between the parts is much higher and the electrical continuity turns out to be stable. On the other hand, the high number of pins in the array implies a rather significant total biasing force, which in turn is transferred to the PWB. In view of that, the pre-preg solution for bonding the PWB to the graphite substrate turns out to be very effective so as to provide a very strong bond between the parts, reducing the risk of detaching when the contact pins are biased. As further alternative (not shown), a PWB having a flexible cable embedded in the rigid structure can be used, wherein the extended outer portion of flexible cable terminates with a series of contacting pads, to be plugged, in turn, into an external socket.

Figure 2:
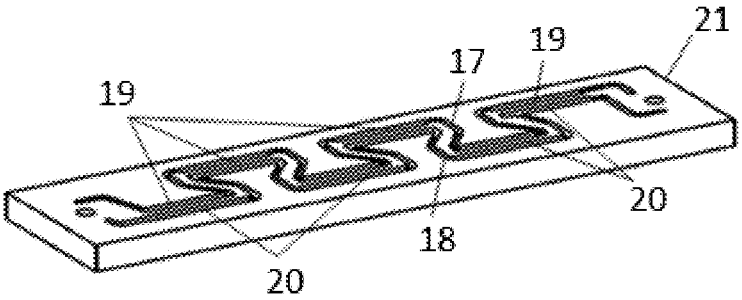
FIG. 2 provides a general view of the multi-chip module.

FIG. 2 illustrates an embodiment of the integration of the ink port and ink channels directly into the graphite substrate, which houses six chips. The back surface of the graphite substrate 21 shows independent ink channels 17 and 18 for the two types of ink, respectively. Ink feeding slots 19 and 20 are realized through the graphite substrate 21, in fluidic communication with the ink channels 17 and 18, respectively, so as each one of the silicon chips in the MCM, mounted at the opposite side of the graphite substrate 21, can be fed with the two inks.

Since the ink channels are embedded in the graphite substrate 21, there is no need for a molded ink port, shaped to house the ink channels, as in the prior art.

Figure 3:
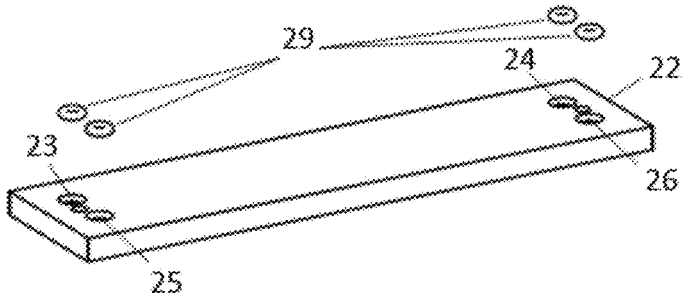
FIG. 3 provides a general view of the cover plate.

A cover plate 22 applied onto the back of the substrate to close the channels at the substrate surface is sufficient. The cover plate 22 is made of graphite, which is light and easy to machine, and comprises suitable ink inlet and outlet ports corresponding to the ends of the ink channels 17 and 18, as it is illustrated in FIG. 3.

In the depicted embodiment, the cover plate is provided with four ink inlet/outlet ports, since the MCM is conceived so as to deliver the ink through two different channels, for example to print with two different inks. In fact, the ink inlet port 23 and the ink outlet port 24 correspond to the end portions of ink channel 17 in FIG. 2, whilst the ink inlet port 25 and the ink outlet port 26 correspond to ink channel 18.

To avoid using protruding hose fittings as in the prior art, each ink port can house the O-rings 29, to provide the hermetic sealing of the module after insertion in the printing equipment (not shown). In its operational arrangement the MCM is pushed against the printing equipment, which has in turn suitable abutments to contrast the O-rings. With this design there is no need in ink hoses to insert in the ink ports and mounting or detaching the MCM from the printing equipment turns out to be much easier.

Figure 4A:
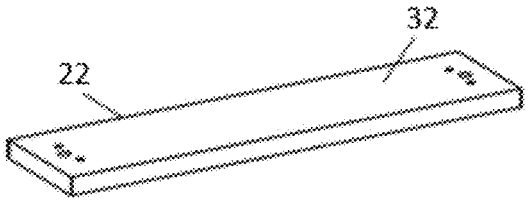
FIG. 4A-B illustrates two alternative embodiments of the cover plate where the inner surface of the cover plate is flat (FIG. 4A) and where the inner surface of the cover plate comprises ink channels (FIG. 4B).
Figure 4B:
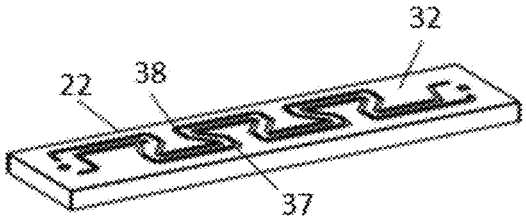

As illustrated in FIG. 4, the inner surface 32 of the cover plate 22 can be either flat or provided with ink channels. In particular, the solution where the inner surface 32 of the cover plate 22 is flat is depicted in FIG. 4A. In this case the inner surface 32 acts simply as the ceiling of the ink channels 17 and 18 of the graphite substrate 21 depicted in FIG. 2. As an alternative, ink channels 37 and 38, conformal to the ink channels 17 and 18, respectively, in graphite substrate 21, are realized in the graphite cover plate 22, as depicted in FIG. 4B, so as to increase the actual channel cross-section. This solution is useful, for example, when a wide channel cross-section is needed and when a possible weakening of the material due to the great depth of the channels has to be avoided, what can happen if channels were entirely made in the substrate.

To bond effectively the graphite cover plate 22 and the graphite substrate 21 a further innovative solution is adopted, which represents an improvement with respect to the traditional methods based on an adhesive glue. The present solution consists in placing an intermediate adhesive layer 30 of a pre-impregnated composite fiber between the two parts, as illustrated in FIG. 5, instead of applying the adhesive glue.

Figure 5:
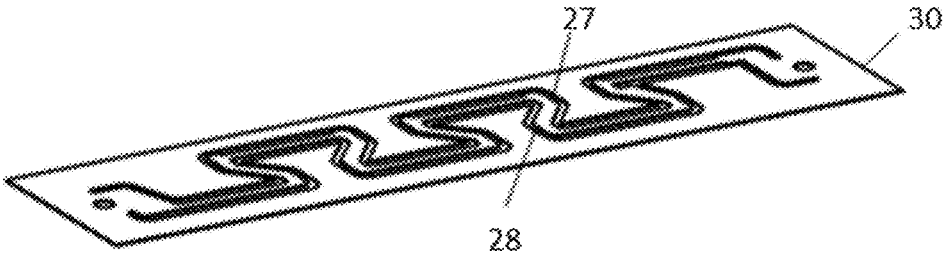
FIG. 5 provides a schematic illustration of the intermediate adhesive layer of a pre-impregnated composite fiber.

The intermediate adhesive layer 30 in FIG. 5 is a sheet of a pre-impregnated composite fiber, including a thermoset material, like the so-called pre-preg, which can be the same material used to bond the PWB board to the graphite substrate or can be different composite fiber material with adhesive properties.

In this embodiment, the graphite cover plate (not shown) comprises a very flat surface, which is fully compatible with the intermediate adhesive layer 30. Suitable apertures 27 and 28 are realized in the intermediate adhesive layer 30 and are conformal to the substrate channels 17 and 18, respectively (depicted on FIG. 2), so as to extend the channel walls, increasing the actual channel depth. The same sealing agent used for the graphite substrate can be used for the graphite cover, so as to prevent the issues caused by its porosity.

The apertures 27 and 28 in the intermediate adhesive layer 30, shaped like the ink channels 17 and 18, respectively, allow the fluidic communication between the ink ports 23, 24, 25 and 26 with the ink channels 17 and 18 and, through the ink feeding slots 19 and 20, the ink can flow to the ejecting chips.

It is fully clear to anyone skilled in the art that the described embodiments can be realized, after some straightforward adjustment, with a MCM where only one ink is used or even with a MCM where more than two inks are used, without departing from the scope of the invention.

It is also clear that the apertures 27 and 28 in the intermediate adhesive layer 30 can be confined to the ink port region, so as to guarantee the ink flow to the ink channels, provided that the ink channels in the graphite substrate 21 are sufficiently deep. In this different solution (not shown), the ink feeding slot in the graphite substrate should be supplied with ink only by the ink channels realized in the graphite substrate. In turn, the inner surface of the cover plate can be either flat or it can be also provided with ink channels communicating with the ink inlet and outlet ports, just to increase the ink recirculation flowrate.

The intermediate adhesive layer 30, sandwiched between the graphite substrate 21 and the graphite cover plate 22, bonded at high temperature and pressure, provides a robust and effective assembly, where the ink channels and the ejection chips are included in a compact structure.

Figure 6A:
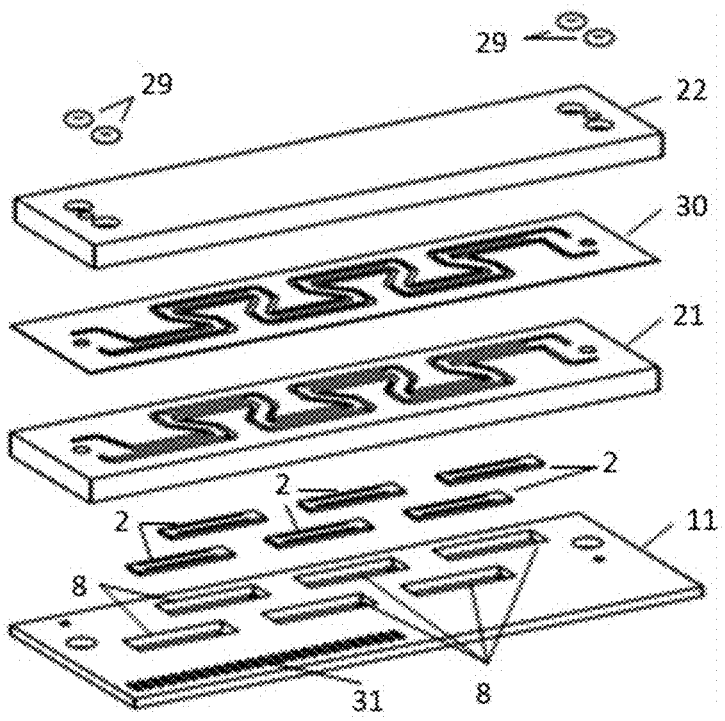
FIG. 6A-C illustrates a whole set of the parts which make up the complete Multi-Chip Module assembly, according to the invention, both in the exploded view (FIG. 6A) and in the assembled view, the latter depicted in the rear-view (FIG. 6B) and in the front-view (FIG. 6C).
Figure 6B:
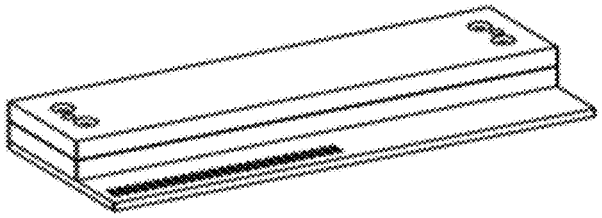
Figure 6C:
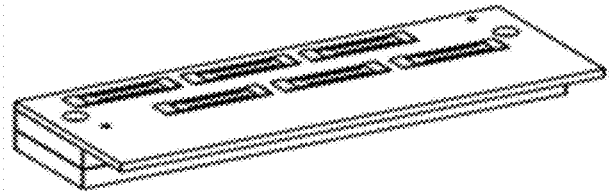

The whole set of the parts which make up the complete Multi-Chip Module assembly, according to the invention, are illustrated in FIG. 6, both in the exploded view (FIG. 6A) as well as in the assembled view, the latter being split in the rear-view (FIG. 6B) and in the front-view (FIG. 6C). The final curing of the pre-preg layers is preferably done in a unique phase on the whole set of the parts, including the PWB.

In one embodiment, the pre-preg layer (the pre-impregnated composite fiber) between the graphite cover plate and the graphite substrate is of the same type as pre-preg layer (the pre-impregnated composite fiber) between the PWB and the graphite substrate. Alternatively, the pre-preg layer (the pre-impregnated composite fiber) between the graphite cover plate and the graphite substrate is of different type from the pre-preg (pre-impregnated composite fiber) between the PWB and the graphite substrate.

As mentioned above, the set of parts that can compose the MCM assembly is illustrated in FIG. 6A. It comprises, from the top to down: a graphite cover plate 22 with O-rings 29; an adhesive intermediate layer 30 of the pre-impregnated composite fiber (pre-preg); a graphite substrate 21 with ink channels at the back side; a plurality of silicon chips 2, mounted at the opposite surface of the graphite substrate; a PWB 11, provided with openings 8 and an array of contact pads 31. The surface of the PWB 11 facing the graphite substrate 21 consists of a suitable pre-preg layer for bonding. The array of contact pads 31 is consistent with the corresponding array of spring biased "pogo pins" in the printing equipment.

Some of the described embodiments can be used alternatively, according to the convenience with respect to the operating conditions, whilst some other embodiments can be joined together to get an extremely performing printing equipment, as can be easily understood by those skilled in the art.

Compared with other known multi-chip module assemblies, the described invention provides a Multi-Chip Module assembly, which is simple, robust, effective, safe, cheap, easy to manufacture due to eliminating of complex operations and the need of using molded parts, and which has an overall improved reliability.

The above disclosed subject matter is to be considered illustrative, and not restrictive, and serves to provide a better understanding of the inventions defined by the independent claims.

The invention claimed is:

1. A multi-chip module (MCM) assembly comprising:

a graphite substrate having a front surface and a back surface and comprising a plurality of silicon chips mounted on the front surface, wherein the MCM assembly further comprises a Printed Wiring Board (PWB) attached to the graphite substrate and provided with openings surrounding outer profiles of the silicon chips, the graphite substrate comprises one or more ink channels on the back surface and one or more ink feeding slots passing through the graphite substrate and being in fluidic communication with the respective one or more ink channels, so that each of the silicon chips can be fed with one or more different types of inks, wherein the PWB is attached to the graphite substrate by means of an intermediate adhesive layer of a pre-impregnated composite fiber having apertures conformal to the ink channels of the graphite substrate, and wherein the MCM assembly further comprises a graphite cover plate configured to cover the one or more ink channels of the graphite substrate, and wherein the graphite cover plate comprises ink inlet and outlet ports having sealing O-ring.

2. The assembly according to claim 1, further comprising an intermediate adhesive layer of a pre-impregnated composite fiber arranged between the graphite cover plate and the graphite substrate.

3. The assembly according to claim 2, wherein the intermediate adhesive layer of a pre-impregnated composite fiber comprises apertures conformal to the ink channels of the graphite substrate.

4. The assembly according to claim 2, wherein the pre-impregnated composite fiber between the graphite cover plate and the graphite substrate is of the same type as the pre-impregnated composite fiber between the PWB and the graphite substrate.

5. The assembly according to claim 2, wherein the pre-impregnated composite fiber between the graphite cover plate and the graphite substrate is of different type from the pre-impregnated composite fiber between the PWB and the graphite substrate.

6. The assembly according to claim 1, wherein an inner surface of the graphite cover plate is flat.

7. The assembly according to claim 1, wherein an inner surface of the graphite cover plate comprises ink channels conformal to the ink channels of the graphite substrate.

8. The assembly according to claim 1, wherein the PWB comprises a layer of a pre-impregnated composite fiber having apertures conformal to the ink channels of the graphite substrate.

* * * * *